United States Patent [19]

Chen et al.

[11] Patent Number: 4,668,377

[45] Date of Patent: May 26, 1987

[54] CATALYTIC PROCESS FOR DEWAXING

[75] Inventors: Nai Y. Chen, Titusville; Bruce P. Pelrine, Lawrenceville, both of N.J.

[73] Assignee: Mobil Oil Corporation, New York, N.Y.

[21] Appl. No.: 789,608

[22] Filed: Oct. 21, 1985

[51] Int. Cl.[4] ..... C10G 11/05; C10G 47/16

[52] U.S. Cl. ..... 208/111; 208/120; 208/146

[58] Field of Search ..... 208/111, 120, 28, 146

[56] References Cited

U.S. PATENT DOCUMENTS

| | | | |
|---|---|---|---|
| 4,257,872 | 3/1981 | LaPierre et al. | 208/59 |
| 4,263,129 | 4/1981 | Chen et al. | 208/111 |
| 4,269,697 | 5/1981 | Chen et al. | 208/120 |
| 4,284,529 | 8/1981 | Shihabi | 208/111 |
| 4,315,814 | 2/1982 | Shihabi | 208/111 |
| 4,332,670 | 6/1982 | Antal | 208/68 |
| 4,357,232 | 11/1982 | Holland et al. | 208/87 |
| 4,358,362 | 11/1982 | Smith et al. | 208/91 |
| 4,377,469 | 3/1983 | Shihabi | 208/111 |
| 4,396,538 | 8/1983 | Chen et al. | 502/77 |
| 4,402,866 | 9/1983 | Shihabi | 208/120 |
| 4,411,770 | 10/1983 | Chen et al. | 208/111 |
| 4,430,200 | 2/1984 | Shihabi | 208/120 |
| 4,434,046 | 2/1984 | Audeh et al. | 208/111 |
| 4,448,673 | 5/1984 | Shihabi | 208/111 |
| 4,473,462 | 9/1984 | Swanson | 208/59 |
| 4,510,045 | 4/1985 | Dessau | 208/111 |

*Primary Examiner*—Olik Chaudhuri

*Attorney, Agent, or Firm*—A. J. McKillop; M. G. Gilman; M. V. Schneller

[57] ABSTRACT

A process for dewaxing lube basestocks over low acidity dewaxing catalysts can be undertaken at steady state temperature. In a preferred embodiment, the feedstock is subjected to catalytic dewaxing with concommident removal of gaseous product. When high boiling feed with end points above 1000° F., such as heavy neutrals and bright stocks, and waxy feeds containing more than 20 wt % wax are subject of the process, it is preferred to use continuously stirred tank reactors.

12 Claims, 3 Drawing Figures

SCHEMATIC OF IMMERSED CATALYST REACTOR SYSTEM

SCHEMATIC OF IMMERSED CATALYST REACTOR SYSTEM

CATALYTIC PROCESS FOR DEWAXING

FIELD OF THE INVENTION

The invention is directed to a process wherein lube based stocks are produced at steady state temperatures over a low acidity dewaxing catalyst. The process employs either a fixed bed catalyst or a continuously stirred tank reactor operating in the liquid phase. The latter reactor is preferred for high boiling feeds with end points above 1000° F., such as heavy neutrals and bright stocks, and waxy feeds containing more than 20 percent waxes.

BACKGROUND OF THE INVENTION

Stocks which are subjected to dewaxing are usually comprised of petroleum fractions boiling above about 343° C. (650° F.). Thus, the molecular weight of the hydrocarbon constituents of those fractions is high, and the constituents themselves display almost all conceivable structures and structure types. The complexity of the molecular constitution of lubricating oils and its consequences are referred to in "Petroleum Refinery Engineering", by W. L. Nelson, McGraw Hill Book Company, Inc., New York, N.Y., 1958 (4th Edition), relevant portions of this text being incorporated herein by reference, for background.

Although the broad principles involved in dewaxing are qualitatively understood, the complexity of the molecular constitution of the petroleum feedstock subject to the hydrodewaxing process, presents complex considerations. That is, components of the feedstocks can undergo competing reactions, which interfere with the primary reactions sought, leading to secondary side reactions. Accordingly, the art of dewaxing has become highly developed and complex.

One of the objects of dewaxing is to render a raffinate feedstock of unacceptably high pour point to a lubricating oil base stock with a decreased, acceptable pour point. In the past, solvent dewaxing has been employed, and is a well known dewaxing process; although effective, solvent dewaxing is extremely expensive. More recently, catalytic methods for dewaxing have been proposed. Many of these current processes describe the use of molecular sieve compositions, specifically zeolites, for dewaxing.

Dewaxing of high-pour feedstocks, involves breakdown and/or rearrangement, by, for example, isomerization, of long straight chain paraffins or of long chain slightly branched paraffins, which are the wax components, sought to be removed. In addition to these wax components, other components within the feedstocks subjected to dewaxing may produce gases, and low molecular weight paraffins. Catalytic dewaxing can involve the competing reactions of breakdown of the wax component, as well as breakdown of the products of dewaxing. The latter breakdown, of products of dewaxing, can, and does, result in decrease in catalytic activity. That decrease in catalytic activity may come about by virtue of contamination of the zeolite catalyst, by low molecular weight fractions, resulting from secondary reactions, which decrease the efficiencies of the process. The production of these lower weight molecular fractions also may produce adverse effects on the quality of the ultimate product sought.

More specifically in catalytic dewaxing with molecular sieves, the lighter products compete with the heavier feed molecules for access to the cracking sites in the zeolites or silica/alumina cracking catalysts which are employed. Inasmuch as these lighter products diffuse more rapidly into the catalyst than the larger feed molecules, they have a tendency to retard the rate of conversion of the heavier molecules. Moreover, the lighter products also tend to be either more difficult to crack, such as low molecular weight paraffins, or easier to polymerize, such as low molecular weight olefins. These lower weight products also possess a tendency to coke the catalyst more readily than their heavier counterparts, thereby retarding the conversion of the heavier molecules to an even greater extent.

This competition between the light and heavy liquid petroleum molecules is rendered particularly critical when a dewaxing catalyst which includes a shape selective zeolite is used. Practically, the competitive reactions that occur during the dewaxing, catalyzed by the zeolites, results in aging of the catalyst. One result of such aging, is the necessity to increase dewaxing temperatures during dewaxing cycles. The limits of increasing the temperatures are, for practical purposes, the temperatures at which the lube products start to exhibit oxidative instability. As the hydrodewaxing temperatures approach that limit, the dewaxing unit(s) must be shut down, and the catalyst itself is then reactivated or regenerated. Depending upon the extent of reactivation, or regeneration, of the catalyst, the starting temperatures of the next cycle for dewaxing may be higher than those of the start of cycle, of the previous dewaxing cycle; thus, start of cycle temperatures may increase, after regeneration and/or reactivation of the catalyst, as well as temperature increase during the dewaxing cycle itself. These temperature increases during the dewaxing cycle, as well as the complete shutdown of the dewaxing unit during regeneration and/or reactivation of the catalyst, obviously lead to high energy inefficiencies.

SUMMARY OF THE INVENTION

In accordance with the invention, the high energy inefficiencies of prior molecular sieve catalyzed dewaxing processes are substantially eliminated. Moreover, the down-time which inheres in those processes, because of the cyclic modes essential, because of reactivation and/or regeneration of the catalyst, are eliminated. Thus, the invention provides predictability of both dewaxing results and operating dewaxing conditions.

In accordance with the invention, lube base stocks are produced at steady-state temperatures. Low acidity dewaxing catalysts are employed, which do not deactivate continuously, as do prior dewaxing catalysts. These low acidity catalysts are the preferred catalysts for this process.

The process may employ either a fixed-bed catalyst system or a continuously stirred tank reactor (CSTR) operating in the liquid phase. The latter type reactor is particularly preferred for high boiling feeds with end points above 1000° F. such as heavy neutrals and bright stocks, and waxy feeds containing more than 20 weight percent wax.

DETAILED DESCRIPTION OF THE INVENTION

As indicated above, the process may be conducted either in a fixed bed catalyst system or in a continuously stirred tank reactor operating in the liquid phase. Because of the preference for using the continuously stirred tank reactor, for high boiling feeds with end points above 1000° F. such as heavy neutrals and bright stocks, and waxy feeds containing more than 20 weight percent waxes, the process of the invention will be discussed in conjunction with the continuously stirred tank reactor. For purposes of illustration, the process will be discussion in conjunction with FIG. 3.

Figure 3:
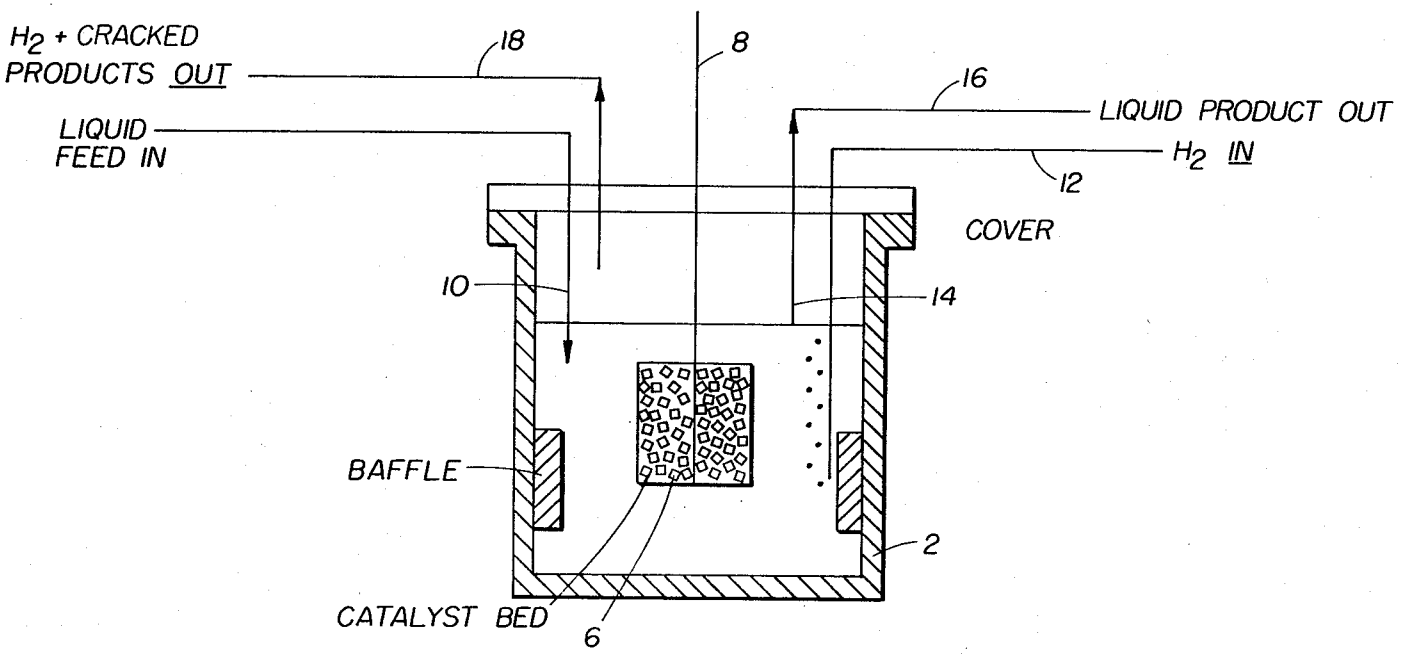
FIG. 3 depicts a continuously stirred tank reactor, useful in application of this invention.

Referring now to the detail in FIG. 3, the reactor consists essentially of an upright or vertically arranged container or tower which can be of cylindrical construction and which has an outer shell or wall 2 and an end cover structure. The reactor is provided with a cylindrical bed of catalyst material which occupies a portion of the reactor. Preferably, in accordance with the invention, the catalyst material comprises a crystalline zeolite, having a constraint index in the approximate range of about 1 to 12.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. The ZSM-22 zeolite has a constraint index of about 2.6 at 800° F. (427° C.). Constraint Index (CI) values for some other typical zeolites are:

| Zeolite | C.I. |
|---|---|
| ZSM-5 | 8.3 |
| ZSM-11 | 8.7 |
| ZSM-12 | 2 |
| ZSM-23 | 9.1 |
| ZSM-38 | 2 |
| ZSM-35 | 4.5 |
| Clinoptilolite | 3.4 |
| TMA Offretite | 3.7 |
| Beta | 0.6 |
| ZSM-4 | 0.5 |
| H-Zeolon | 0.4 |
| REY | 0.4 |
| Amorphous Silica-Alumina (non-zeolite) | 0.6 |
| Erionite | 38 |

It is to be realized that the above constraint index values typically characterize the specified zeolites but that these are the cumulative result of several variables used in determination and calculation thereof. Thus, for a given zeolite depending on the temperature employed within the aforenoted range of 550° F. to 950° F., with accompanying conversion between 10% and 60%, the constraint index may vary within the indicated approximate range of 1 to 12. Likewise, other variables, such as the crystal size of the zeolite, the presence of possible occluded contaminants and binders intimately combined with the zeolite may affect the constraint index. It will accordingly be understood by those skilled in the art that the constraint index, as utilized herein, while affording a highly useful means for characterizing the zeolites of interest is an approximation, taking into consideration the manner of its determination, with probability, in some instances, of compounding variable extremes.

While the above experimental procedure will enable one to achieve the desired overall conversion of 10 to 60% for most catalyst samples and represents preferred conditions, it may occasionally be necessary to use somewhat more severe conditions for samples of very low activity, such as those having a very high silica to alumina mole ratio. In those instances, a temperature of up to about 1000° F. and a liquid hourly space velocity of less than one, such as 0.1 or less, can be employed in order to achieve a minimum total conversion of about 10%.

The class of zeolites defined by such a constraint index is exemplified by ZSM-5, ZSM-11, ZSM-12, ZSM-35 and ZSM-38. U.S. Pat. No. 3,702,886 describes in claims ZSM-5, and is incorporated herein by reference. U.S. Pat. No. 3,709,979, the entire contents of which are incorporated by reference herein, describes ZSM-11. ZSM-12 is more particularly described in U.S. Pat. No. 3,832,449, the entire contents of which are incorporated herein by reference. U.S. Pat. No. 4,016,245, the entire contents of which are incorporated herein by reference, describes ZSM-35. ZSM-38is more particularly described in U.S. Pat. No. 4,046,859, the entire contents of which are incorporated by reference herein.

Preferably, the zeolite having the constraint index within the approximate range of 1 to 12 has an alpha value of 0.1 to 10, more preferably an alpha value of 1 to 10. The alpha value, is determined by the alpha test, which is an indication of the relative catalytic cracking activity of the catalyst compared to a standard catalyst. The value of alpha is the relative rate constant (rate of n-hexane conversion for unit volume of catalyst per unit time). It is based on the activity of highly active silica/alumina cracking catalyst taken as an alpha=1. The alpha test is further described in a letter to the editor, entitled "Superactive Crystalline Alumino-Silicate Hydrocarbon Cracking Catalysts", by P. B. Weisz and J. N. Miale, *Journal of Catalysis,* Vol. 4, pp. 527–529 (August, 1965) and in U.S. Pat. No. 3,354,078, the entire contents of each being incorporated by reference herein.

Figure 1:
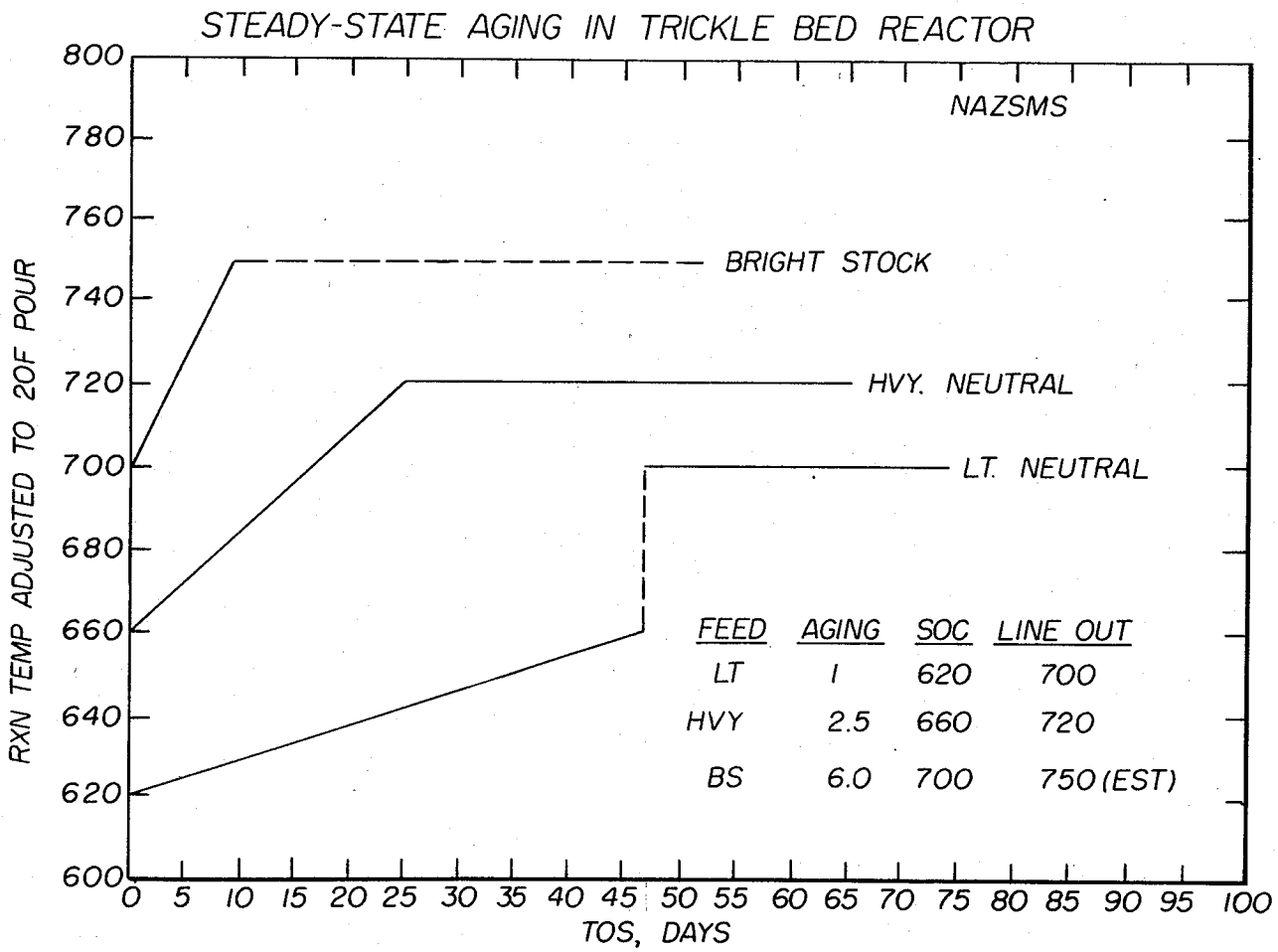
FIG. 1 is a graph of reaction temperature adjusted to producing dewaxed product of 20° F. pour point plotted against total days on stream.

In experiments which produced the results which are set forth in FIG. 1, the zeolite used was the sodium form of ZSM-5. Low acidity zeolites, particularly those containing alkali metal cations, operate at higher temperatures than more active zeolites. At the higher dewaxing temperatures required to obtain acceptable pour points, the affinity for poisonous compounds in the feed is less. Therefore, they are affected less by them as compared to high acidity zeolites. At the higher temperatures an equilibrium is established with the poisons, whereas at lower dewaxing temperatures used by the more active zeolites, the poisons are irreversibly adsorbed. The hydrogen form of the zeolite, useful in certain hydrocarbon conversion processes, is prepared, for example, by base exchanging any alkali metal ions, with, e.g, ammonium chloride or hydroxide to produce the ammonium form of the zeolite. The composition is then calcined at a temperature of, e.g., 1000° F., causing evolution of ammonia and retention of the hydrogen proton in the composition. Ion exchange of the thus calcined zeolite to convert it to the sodium form can be accomplished conventionally, e.g. by admixing the zeolite with a solution of a cation to be introduced into the zeolite. Ion exchange with various metallic and non-metallic cations can be carried out according to the procedures described in U.S. Pat. Nos. 3,140,251; 3,140,252; and 3,140,253, the entire contents of which are incorporated herein by reference.

The zeolite may be used neat, or admixed with a binder or matrix material to increase its resistance to temperature and dewaxing process conditions. Useful matrix materials include both synthetic and naturally occurring substances, as well as inorganic material such as clay, silica and/or metal oxides. The latter may be either naturally occurring or in the form of gelatinous precipitates or gels, including mixtures of silica and metal oxides. Naturally occurring clays, which can be composited with the zeolite include those of the montmorillonite and kaelin families. Such clays can be used in the raw state as originally mined or initially subjected to calcination, acid treatment or chemical modification. In addition, the zeolite may be composited with a porous matrix material such as alumina, silica-alumina, silica, silica-magnesia, silica-zirconia, silica-thoria, silica-beryllia, silica-titania, as well as terniary compositions such as silica-alumina-thoria, silica-alumina-zirconia, silica-alumina-magnesia and silica-magnesia-zirconia. The matrix can be in the form of cogel. The relative proportions of the zeolite component and the support material component can vary. The support material can comprise 10 to 90 percent by weight of the catalyst composition, with the remainder being the zeolite.

Returning to FIG. 3, the catalyst bed is mounted and contained so that it can be rotated rapidly while submerged in a liquid oil phase. Rotation, in rpm, can range from 50 to 500.

Liquid petroleum feedstock to be dewaxed is introduced into the reactor and maintained primarily in a liquid phase as it permeates the bed of catalyst. Preferably, the feedstock to be dewaxed is injected into the bottom of the reactor. Feedstocks, which vary widely in their wax content, can be dewaxed in accordance with the process of the invention. Feedstocks which have been previously hydrotreated or hydrogenated and which consequently contain little or no sulfur can also be dewaxed by this process. The liquid feedstock preferably has a boiling point between 650 and 1300° F., a pour point above 85° F. and a sulfur content above 0.3 weight percent. The type of reactor embodied by FIG. 3, is preferred, over fixed bed catalyst systems or trickle bed systems, for high boiling feeds with end points above 1000° F. such as heavy neutrals and bright stocks, and waxy feeds containing more than 20 weight percent waxes.

In accordance with the embodiment of the continuously stirred tank reactor of FIG. 3, the liquid feed is in contact with the catalyst, while the catalyst bed is rotated rapidly and the dewaxing operation is carried out. Alternatively although not exemplified, the catalyst bed may be catalysts suspended in the liquid feedstock, subjected to continuous agitation. The exact configuration of the catalyst bed has no part of the present invention. The catalyst bed can be, for example, supported in part on trays arranged along the axis of the reactor, can be a single continuous body, or a suspension in the feedstock. However, it is an important aspect of the invention, that the catalyst bed is submerged in the petroleum feedstock being dewaxed and that its design be such as to minimize the contact time between catalysts and the product gases formed during dewaxing. To this end, in the embodiment of the continuously stirred tank reactor illustrated in FIG. 3, the catalyst bed is designed to be rotated rapidly around axial support 8 to effect disengagement of gases on the catalyst. The speed of revolution is easily determined by preliminary testing prior to going on stream.

The liquid petroleum feedstock is introduced into the reactor via inlet line 10, which in the embodiment described in FIG. 3, extends into the reactor so as allow feedstock to flow through the catalyst bed thereby completely submerging the catalyst in the oil phase. Conditions in the reactor can be conventional. Pressures in the reactor range from 100 to 2000 psig, and preferably range from 200 to 1500 psig; in experiments undertaken to produce the results recorded in FIGS. 1 and 2, the pressure ranged from 400 to 500 psig. The liquid hourly space velocity of the feedstock can range from about 0.1 to 10, and preferably ranges from 0.1 to 2.

The temperature conditions in the reactor are steady state temperatures. The exact temperature will be determined empirically before going on stream, and the exact temperature can range from 260 to 482° C., and preferably from 343 to 427° C.

The reactor embodied in the illustration of FIG. 3, is provided with a line 12 for injection of gas, preferably hydrogen, which is bubbled up through the catalyst bed in the oil phase. The hydrogen flow rate to the reactor can range from about 10 to about 300 cc/min. In part, the effect of the injected gas is to degasify the liquid being treated so that the gases formed during the dewaxing operation are more freely liberated from the oil phase. Moreover, in conjunction with the agitation, illustrated by FIG. 3, the effect of the gas, in combination with rotation and/or agitation, is to minimize the contact time between the catalyst and the product gases. Ultimately, this leads to reduction in over cracking products and polymerization of the over cracked products. Accordingly, in accordance with the invention, the product of dewaxing is allowed to escape from the reaction zone, as it is formed, while dewaxing of feedstock continues. Gases accumulating in the top of the reactor are removed through exit line 18. The oil phase can be carried off at point 14 through lines 16 above the catalyst bed and from the reactor. The process may be undertaken in a fixed bed reactor.

Figure 2:
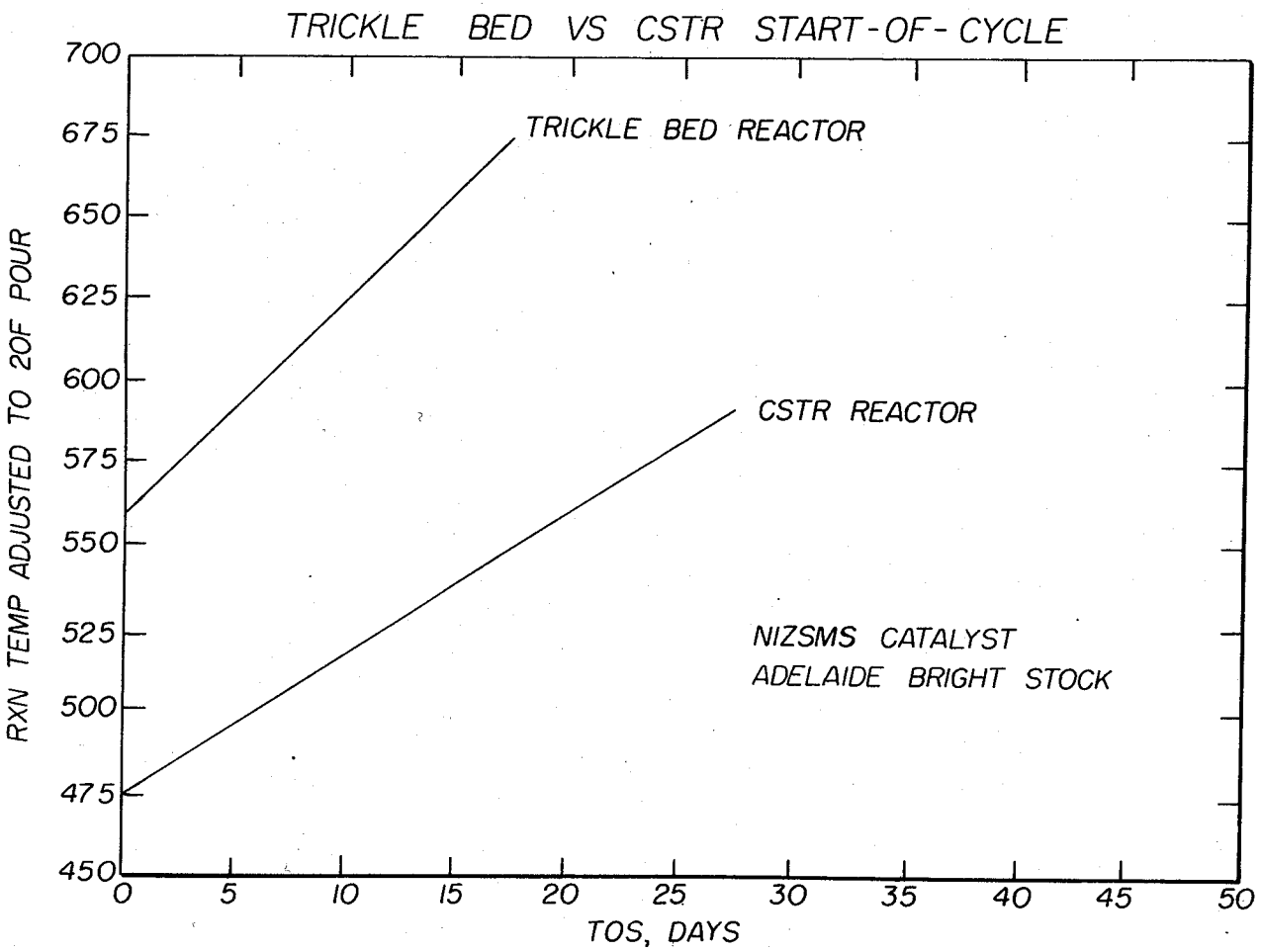
FIG. 2 is a graph of dewaxing reaction temperatures adjusted to achieve a product of 20° F. pour point plotted against total days on stream, in dewaxing undertaken in the presence of prior catalyst systems.

Description of Experiments Resulting In Graphs of FIGS. 1 and 2

FIG. 1 records the trickle bed results showing steady state operation for the dewaxing of light and heavy neutral raffinates over a low acidity sodium ZSM-5. The sodium form of ZSM-5 used in the Examples was characterized by an alpha value of 1. Also shown in an aging rate for bright stock and is proposed steady state temperature. This figure demonstrates line-out operations.

The experiments producing the results for dewaxing light and heavy neutral raffinates over a low acidity sodium ZSM-5, as recorded in FIG. 1, typically included the following conditions. The process was lined out at about 700° to 720° F., at pressures of about 400 psig and an LHSV of about 1 (specifically ranging from 1.04 to 1.09, with a target pour point of about 20° E.).

In FIG. 2, start of cycle temperatures are compared for bright stock dewaxing over steamed nickel ZMS-5 catalyst in a trickle bed reactor and in a continuously stirred tank reactor. The start of cycle (SOC) temperature is 560° F. (1) LHSV) for a trickle bed and 474° F. for the continuously stirred tank reactor. The difference in start of cycle temperatures, between the trickle bed and the continuously stirred tank reactor, translates to an 86° F. catalyst activity advantage; this advantage is particularly useful when the upper operating temperature required approaches 700° F., such as in processing high boiling feeds with end points above 1000° E. or waxy feeds containing more than 20 weight percent waxes.

What is claimed is:

1. A process for hydrodewaxing feedstocks containing wax components which causes the feedstock to be characterized as high-pour, which process comprises (a) contacting said feedstock in liquid form, under hydrodewaxing conditions, includes elevated temperature, with a catalyst composition in a reaction zone wherein said catalyst composition comprises a zeolite having a constraint index within an approximate range of about 1 to 12 and having an alpha-value of about 1 to about 10;

(b) maintaining the catalyst in the liquid feedstock and subjecting the liquid feedstock to agitation equivalent to from 50 to 500 rpm, while (c) allowing products of hydrodewaxing, produced under said hydrodewaxing conditions, to volatilize, from the reaction zone, to produce a product of at least substantially constant pour point which is less than that of the feedstock, and (d) the elevated temperature is maintained throughout (a)-(c) at substantially constant temperature.

2. The process of claim 1, wherein said alpha value ranges from 1 to 10.

3. The process of claim 1, wherein said hydrodewaxing conditions include liquid hourly space velocity which ranges from 0.1 to 10.

4. The process of claim 1, wherein said hydrowaxing conditions include a liquid hourly space velocity which ranges from 0.1 to 2.

5. The process of claim 3, wherein said alpha value ranges from 1 to 10.

6. The process of claim 4, wherein said alpha value ranges from 1 to 10.

7. The process of claim 1, wherein the zeolite is ZSM-5.

8. The process of claim 3, wherein the zeolite is ZSM-5.

9. The process of claim 5, wherein the zeolite is ZSM-5.

10. The process of claim 7, wherein the zeolite is ion-exchanged with a source of sodium cation.

11. The process of claim 8, wherein the zeolite is ion-exchanged with a source of sodium cation.

12. The process of claim 9, wherein the zeolite is ion-exchanged with a source of sodium cation.

* * * * *